United States Patent [19]

Stark

[11] Patent Number: 4,512,397

[45] Date of Patent: Apr. 23, 1985

[54] HOUSING FOR CROSS FLOW HEAT EXCHANGER

[76] Inventor: Walter Stark, 630 New York Ave., Huntington, N.Y. 11743

[21] Appl. No.: 562,456

[22] Filed: Dec. 16, 1983

Related U.S. Application Data

[63] Continuation-in-part of Ser. No. 382,383, May 27, 1982, abandoned.

[51] Int. Cl.[3] ..... F28F 3/00

[52] U.S. Cl. ..... 165/166; 165/165

[58] Field of Search ..... 165/165, 166, 167

[56] References Cited

U.S. PATENT DOCUMENTS 4,042,018 8/1977 Zebuhr ..... 165/166

4,046,529 9/1977 Fletcher et al. ..... 165/166 X 4,327,803 5/1982 Muellejans et al. ..... 165/166

FOREIGN PATENT DOCUMENTS 2630551 1/1977 Fed. Rep. of Germany ..... 165/166

*Primary Examiner*—Stephen F. Husar

*Attorney, Agent, or Firm*—Alfred M. Walker

[57] ABSTRACT

A cross flow heat exchanger is provided comprising a longitudinal duct housing and a heat exchange element positioned offset and diagonally in two planes therein. This design permits air to be introduced to the heat exchanger element through a tapered converging plenum, so that air is efficiently introduced into the said heat exchanger element, and to exit said heat exchanger element through a diverging reverse tapered plenum.

7 Claims, 10 Drawing Figures

Prior Art

HOUSING FOR CROSS FLOW HEAT EXCHANGER

This is a continuation-in-part of my earlier application Ser. No. 06/382,383, filed May 27, 1982, which is now being abandoned.

BACKGROUND OF THE INVENTION

1. Field of Invention

The instant invention is designed for the improvement of cross flow heat exchangers. Such cross flow exchangers are used principally in outside air heating or cooling systems for preheating or cooling outside air using exhaust air as the heating medium. The typical heat exchanger normally operates with two air sources. Said air sources are kept apart from one another and only the sensible and/or total heat of said air streams are permitted to be exchanged.

2. Description of Prior Art

The prior art consists of a variety of cross flow air to air heat exchangers of various efficiencies. As noted above, said heat exchangers are used mainly for heating or cooling whereby they function by the degree of warmth or chill from one air stream being transmitted to a second air stream without the two air streams coming into direct contact with each other.

The heat exchanger element typically has two sets of channels for the two sets of air streams, which are separated from each other by alternate series of heat-permeable walls, e.g. paper with folded corrugations, as shown in FIG. 4. Generally, the air flows in conventional heat exchangers are perpendicular to each other, and the channels of the heat exchanger element are aligned respectively with said perpendicular air flows. If one desires to utilize more than one heat exchanger, said heat exchangers must be placed serially in a row either horizontally or vertically unless ducts are used to direct the flow of air outward from one of the initial heat exchangers into a second heat exchanger. This necessitates a greater use of space volume for the installation of multiple heat exchanger elements. The conventional methods thus have the problem of efficiency of space usage because the heat exchangers must be placed serially in a row or with the use of inter-connecting ducts between elements groups.

SUMMARY OF THE INVENTION

The instant invention consists of an improved heat exchanger so that air flow is accomplished in a manner entirely different from that outlined above in the prior art. This new air flow configuration permits the directional flow of air to be completed in such a manner as to maximize the efficiency of air flows while minimizing the use of space for purposes of multiple installations of heat exchanger units. This improvement comprises a longitudinal housing directing the flows of the two air streams, which are parallel to each other at the entrance and exit to the heat exchanger, and providing an offset, diagonal positioning of the heat exchange element within the housing. The input and exit plenums taper gradually in a converging or diverging manner in the longitudinal direction of the housing such that the resultant pressure drop in air flow through the heat exchanger and the space requirements are kept to an absolute minimum. The improved configuration allows a small compact unit that saves space and which can be stacked in multiple quantities horizontally, vertically, or both in a quad formation with two on top of two, or multiples of same. Referring to the example of the heat exchangers in the description of prior art, it is not necessary to place the heat exchangers serially or to connect same with ducts. Rather, a number of heat exchangers, typically four, can be placed two on top of two, because the said offset, diagonal positioning of the element within the housing allows the two air streams to enter and exit in the same longitudinal direction thereby facilitating the stacking of the heat exchangers both horizontally and vertically at the same time.

The instant invention also consists of designing the inlet to the heat exchanger in such a way so as to initially maximize the air inlet area. Typically, when air enters a conventional system there is a decrease in air velocity and a drop in pressure due to the fact that a portion of the air is absorbed into the grid formation of the inlet channels of the heat exchange element. Conversely there is typically an air pressure increase for the exiting air stream. In the instant invention, the design of the housing maximizes the efficiency of the unit by decreasing or increasing the cross-sectional area through tapering inlet and exit plenums to correspond to the expected drop or increase in air pressure. By directing a large quantity of air through strategically placed tapered plenums within the heat exchanger housing the instant invention maximizes the efficiency of the unit by decreasing or increasing the cross-sectional area to minimize air pressure differences.

This design creates the following effect of air which facilitates the flow of air within the system. The tapered input plenum results in an ever-decreasing area for inlet air and yields a significantly more efficient design than previous heat exchangers. The tapered exit plenum also permits the exiting of inlet air through a maximum diverging duct area. This reverse tapered plenum, positioned for purposes of maximizing the efficiency of the unit, results in an increase of flow of air through the exit duct, because the exit plenum increases in its cross-sectional area as the air exits.

The tapered plenums are formed by the diagonal positioning of the heat exchanger element within the housing in two planes, with corresponding partitions connecting portions of the inner walls of the housing dividing the air streams to the respective diagonal walls of the heat exchanger housing, thereby creating a funnel effect.

By the diagonal placement of the heat exchange element within the longitudinal housing, the direction of air flow within the inlet and exit plenums of applicant's invention is perpendicular to the direction of air flow within the heat exchanger element. Not only does this facilitate the flow through the tapered inlet plenum, but it also yields a lower spatial requirement and minimal interconnecting duct work. This contrasts to the direction of air flow within conventional inlet chambers wherein the direction of air flow is generally the same as the direction within the element.

BRIEF DESCRIPTION OF THE DRAWING FIGURES

FIG. 1 is a side view of the intention showing the air to air cross flow heat exchanger.

FIG. 2 of the drawing is a cross section along lines 2—2.

FIG. 3 of the drawing is a cross section of the invention along lines 3—3.

FIG. 4 of the drawing shows a typical heat exchanger element.

FIG. 5 of the drawing shows alternate inlet and outlet arrangements to the invention.

FIG. 6 of the drawing shows the direction of two air streams flowing in the same direction.

FIG. 7 of the drawing shows the direction of two air streams flowing in the opposite direction.

FIG. 8 of the drawing shows the direction of two air streams flowing in the opposite direction.

DESCRIPTION OF THE PREFERRED EMBODIMENTS

Figure 1:
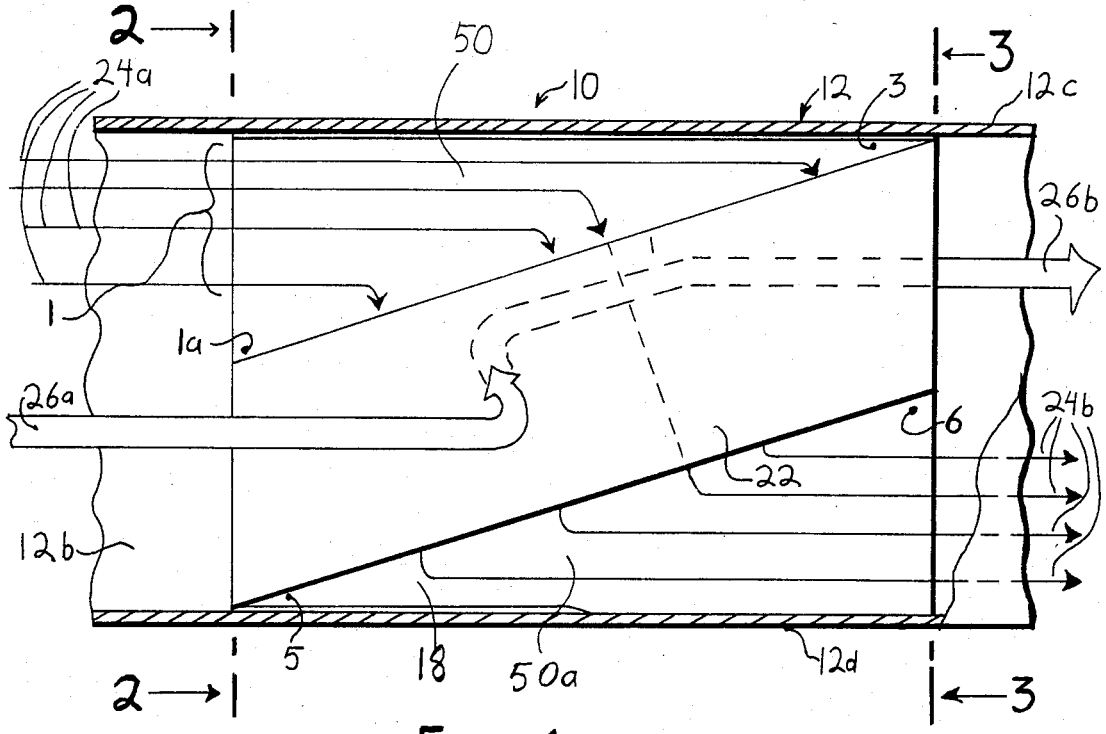

Referring descriptively to the drawing, in which similar reference characters denote similar elements throughout the several views, the drawing illustrates the improved heat exchanger of the invention generally indicated by reference numeral 10.

Figure 2:
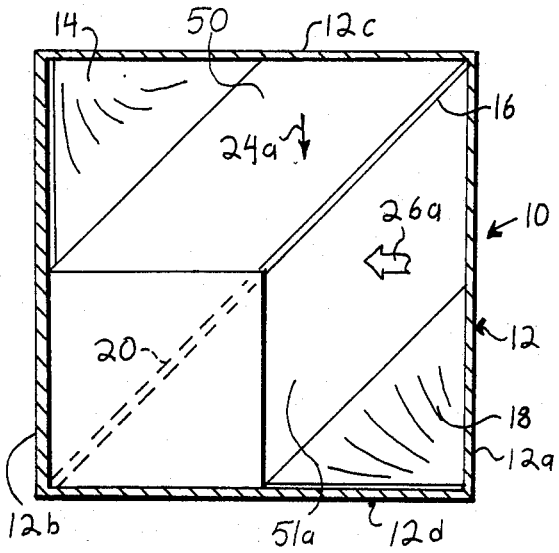
Figure 3:
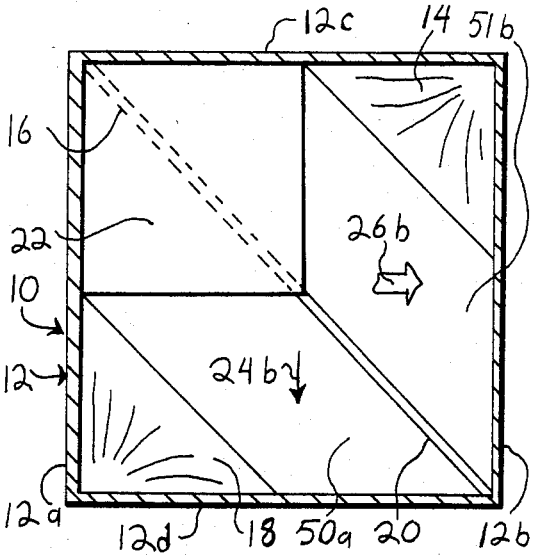

Referring to FIGS. 1, 2 and 3, the housing consists of a duct 12 wherein a heat exchanger element 22 is positioned offset diagonally in two planes within said duct 12. Influent air 24*a* of one air stream enters at plenum 50 which has tapered walls defined by the diagonal walls of heat exchanger element 22 generally shown by the line from 1*a* to 3 as shown in FIG. 1. The effluent air 24*b* exits along the other diagonal surface of the heat exchanger element defined by the line from 5 to 6 into plenum 50*a* encased between partition 18 and 20. The effluent air then exits out of said duct.

Figure 6:
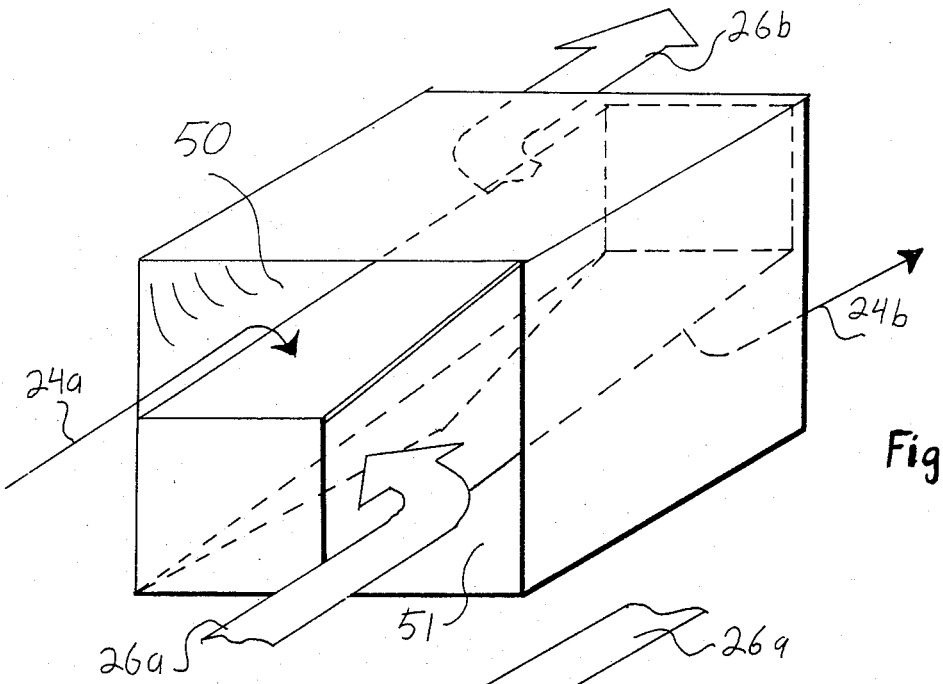

A second air stream is designated 26*a* and 26*b* and the heat transfer occurs between the aforesaid second air stream and 24*a* and 24*b*. The second air stream 26*a* enters at plenum 51, as seen in FIG. 6 and is also forced through the heat exchanger element 22 in a cross flow direction to that of flow 24*a* and 24*b*. This second air stream exits plenum 51*a* and 26*b*. The diagonal offset positioning of the heat exchanger element, when combined with partitions 14 and 20 creates a tapered plenum which maximizes the efficiency of the system. Said heat exchanger element 22 is positioned so that its axis extending from the inlet end of the housing duct 12 to the exit end of the said duct 12 extends diagonally in two planes, commonly at 90° apart perpendicular to each other within said duct and partitions 14 and 20 are placed along the edges of said element and extend to the corresponding edge of the housing 12 so that the complimentarily tapered inlet and exit plenums are formed.

Figure 7:
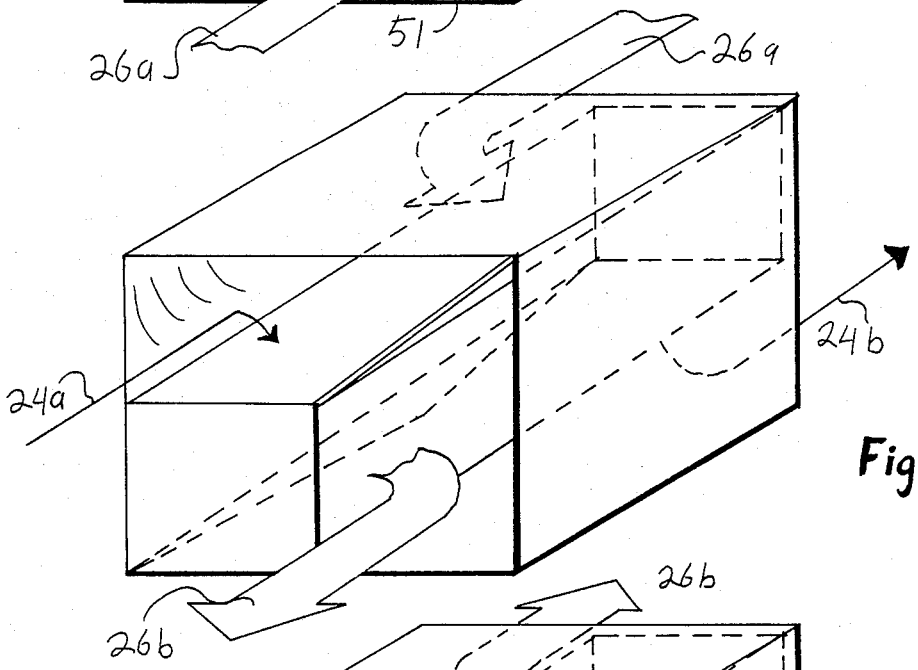

FIG. 6 shows the two air flows in the same direction while FIG. 7 shows the two air flows in opposite direction.

Figure 8:
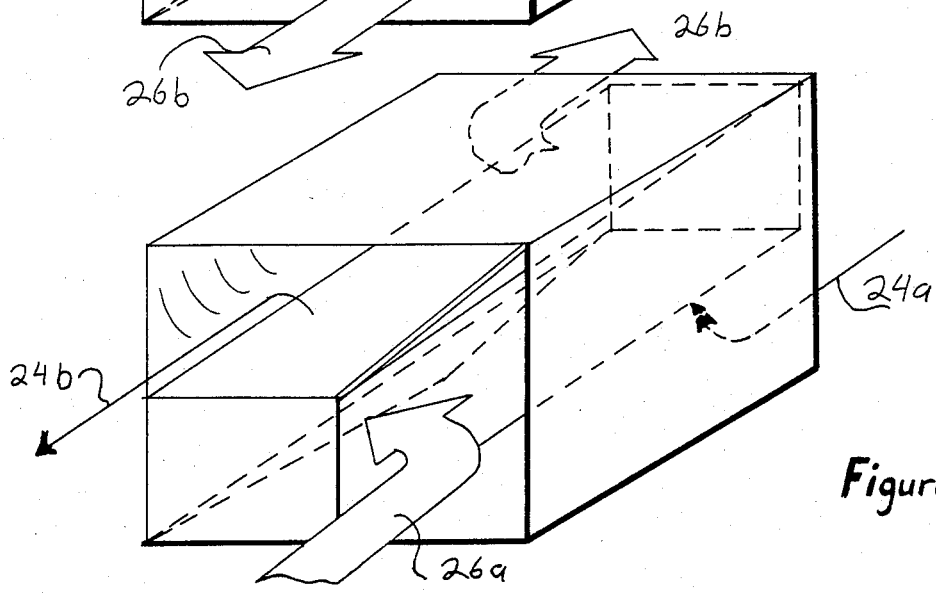

FIG. 8 shows the air flows in opposite direction to that shown in FIG. 7.

Figure 4:
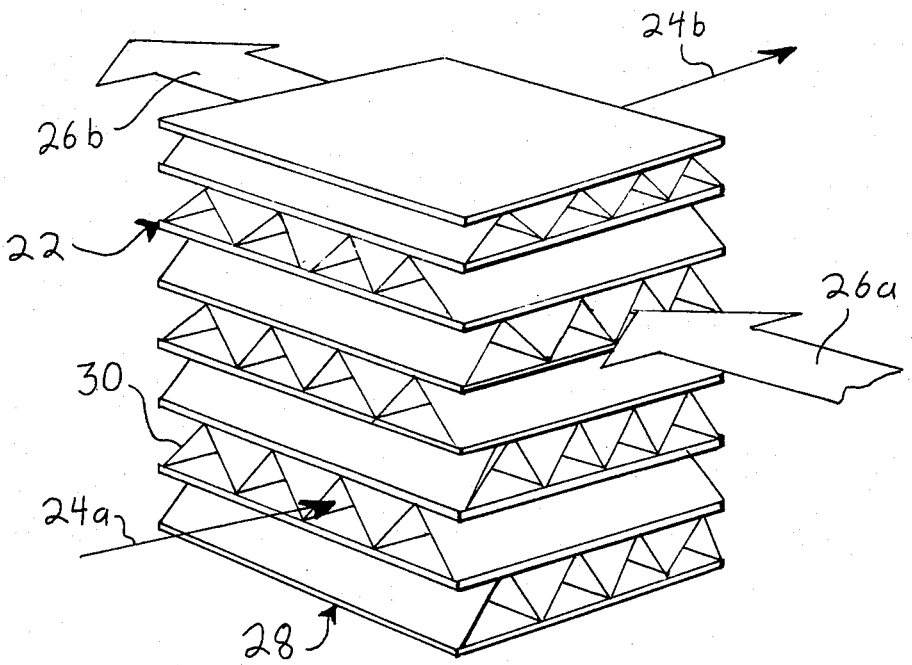

The duct 12 consists of sides 12*a*, 12*b*, 12*c* and 12*d*. Suitable partitions such as 14, 16, 18 and 20 are provided so as to define plenums 50 and 51 in order to separate the two air flows. The plenums direct the flow of air in order to maximize the efficient use of air flows. FIG. 4 shows a typical cross flow heat exchanger element 22 which consists of a series of fins 30 and partitions 28 in order to keep two air flows from mixing together but at the same time allowing the heat transfer to occur.

Figure 5:
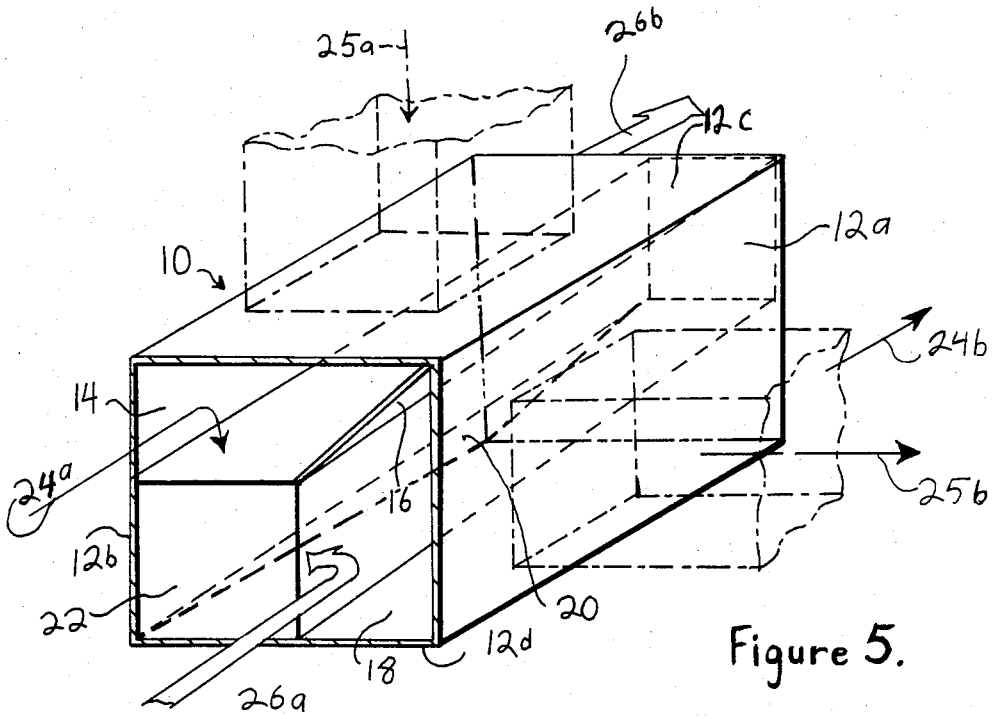

FIG. 5 shows an alternative configuration where the air flow may enter and exit duct 12 from a perpendicular direction 25*a* and 25*b* respectively. This is contrasted to the previously described longitudinal direction.

The instant invention allows the largest amount of influent air to be directed into the largest cross-sectional area and minimizes the pressure drop as air continues within the tapered plenum defined by the position of the plenum within the element. Such would not be the case if said influent air was directed into a constant air passage as is done with conventional heat exchanger housings. The tapered-shaped passageways of chamber plenums 50, 51 and the reciprocal opposite exit chambers are so shaped to provide the air with an efficient flow passage. Air is compressed by the tapered inlet plenums and partitions with respect thereto so that the largest amount of influent air directed into said tapered inlet plenums is directed into said plenums having ever-decreasing cross-sectional areas, thereby yielding a smaller pressure drop than if directed into plenums with constant cross-sectional areas.

Figure 9:
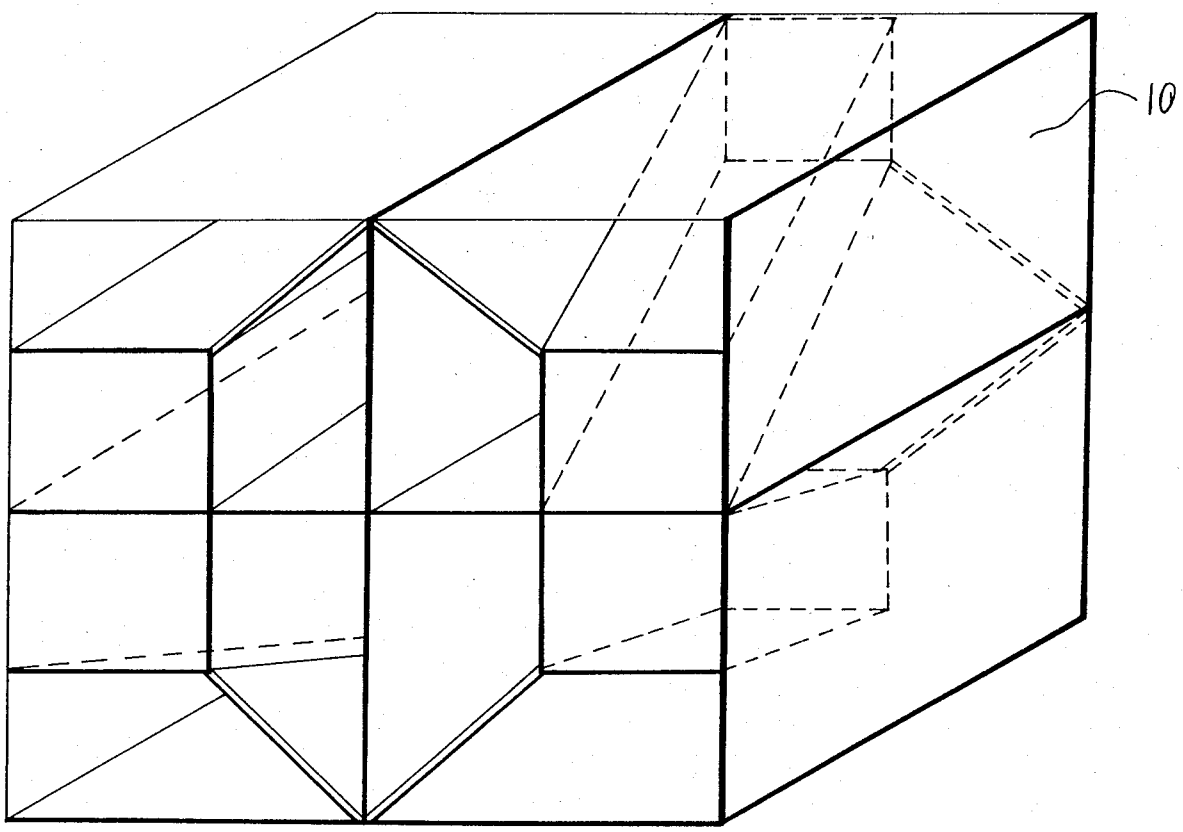
FIG. 9 shows a plurality of the heat exchangers shown in a quad position with two heat exchangers on top of two heat exchangers.
Figure 10:
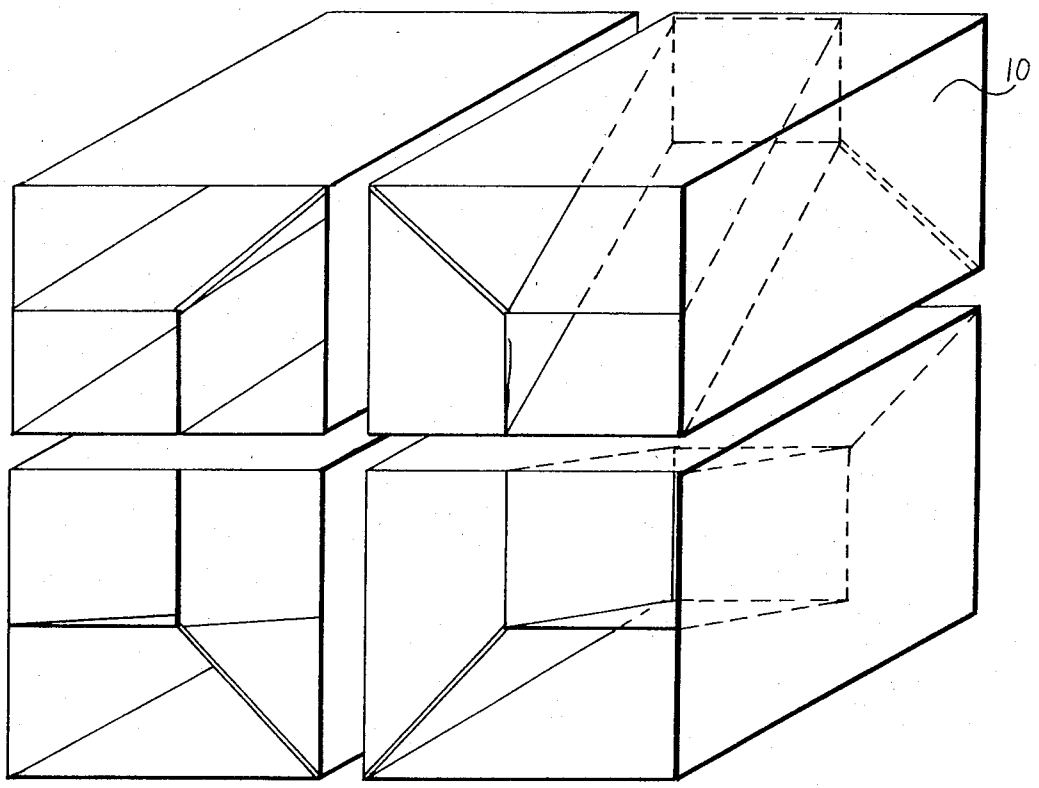
FIG. 10 is an exploded view of FIG. 9.

FIG. 9 refers to the positioning of a plurality of housings in a quad position with two over two. This embodiment is not necessarily limited to a total of four but can be used with any number of heat exchangers in clusters of four. The configuration of the heat exchangers in the quad position maximizes space efficiency. One no longer needs to position heat exchangers serially in one direction. In addition, it is not necessary to utilize ducts connecting one heat exchanger to another heat exchanger so as to facilitate a direction other than serially.

The instant invention therefore provides a significantly different approach to the process of heating and cooling input air by a heat exchanger element. When air passes through the heat exchanger element 22 said air exits through an outwardly expanding passageway which is tapered in reverse. This provides for efficient air flow as the volume of air increases with the cross-sectional area of the exit plenum.

While the aforementioned structure herein described constitutes a preferred embodiment of the invention, it is understood that the invention is not limited to this precise form and that changes may be made therein without departing from the scope of this invention.

Having regard to the foregoing disclosure I claim the following:

1. An improved cross flow heat exchanger of the type wherein two air streams are passed near one another through a heat exchanger element and the heat exchanger element keeps the two gases from coming into contact with one another but at the same time permits heat transfer from the hotter gas to the colder gas wherein the improvement comprises:

a duct type longitudinal housing having inlet and exit ends and walls for directing the two air streams longitudinally therethrough, said heat exchanger element being positioned in said longitudinal housing offset and diagonally in two planes therein, wherein the walls of the housing and of said offset, diagonal heat exchanger element define tapered, converging inlet and diverging exit plenums.

2. An improved cross flow heat exchanger as recited in claim 1 further comprising a plurality of said duct type housing arranged adjacent to each other in at least one serial direction.

3. An improved cross flow heat exchanger as recited in claim 1 wherein said heat exchanger element is positioned so that its axis extending from the inlet end of the housing to the exit end of the said housing extends diagonally in two perpendicular planes at 90° apart within said housing and a partition is placed along an edge of said element and extending to a corresponding edge of said housing so that tapered inlet and outwardly expanding exit plenums are formed.

4. An improved cross flow heat exchanger as recited in claim 1 wherein said tapered inlet plenum gradually converges with an ever decreasing cross-sectional area, thereby in order to minimize the pressure drop of an input air stream therethrough.

5. An improved cross flow heat exchanger as recited in claim 1 wherein said exit plenum has an ever increasing cross sectional area corresponding to an increasing air volume in order to minimize the pressure drop in an output air stream therethrough.

6. An improved cross flow heat exchanger as recited in claim 1 wherein airflow enters and exits the heat exchanger element perpendicular to the direction of said airflow within said heat exchanger element.

7. An improved cross flow heat exchanger as recited in claim 2 wherein the plurality of duct type housings comprises a quad positioning of said duct type housings two over two.

* * * * *